US010997921B2

(12) United States Patent
Shin et al.

(10) Patent No.: US 10,997,921 B2
(45) Date of Patent: May 4, 2021

(54) ORGANIC LIGHT-EMITTING DISPLAY DEVICE

(71) Applicant: LG Display Co., Ltd., Seoul (KR)

(72) Inventors: Sang-Il Shin, Seoul (KR); HyoYoung Jun, Daegu (KR); SangHoon Jeong, Iksan-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/712,872

(22) Filed: Dec. 12, 2019

(65) Prior Publication Data

US 2020/0193907 A1 Jun. 18, 2020

(30) Foreign Application Priority Data

Dec. 13, 2018 (KR) ..... 10-2018-0160710

(51) Int. Cl.
*G09G 3/3258* (2016.01)

(52) U.S. Cl.
CPC ... *G09G 3/3258* (2013.01); *G09G 2300/0439* (2013.01); *G09G 2310/08* (2013.01); *G09G 2330/021* (2013.01)

(58) Field of Classification Search
CPC ..... G09G 3/3258; G09G 2300/0439; G09G 2310/08; G09G 2330/021
USPC ..... 345/212
See application file for complete search history.

(56) References Cited

U.S. PATENT DOCUMENTS

2013/0016091 A1 1/2013 Kato et al.
2013/0194248 A1* 8/2013 Kim ..... G09G 3/3233 345/212
2013/0321376 A1* 12/2013 Kim ..... G09G 3/3233 345/212
2015/0109278 A1* 4/2015 Kim ..... G09G 3/3266 345/211
2017/0186372 A1 6/2017 Yanase et al.
2019/0296099 A1* 9/2019 Lee ..... H01L 27/3246
2020/0185489 A1* 6/2020 Jo ..... H01L 51/5209

* cited by examiner

*Primary Examiner* — Chanh D Nguyen
*Assistant Examiner* — Ngan T. Pham-Lu
(74) *Attorney, Agent, or Firm* — Seed IP Law Group LLP

(57) ABSTRACT

Provided is an organic light-emitting display device. The organic light-emitting display device includes at least a pixel circuit comprising an organic light-emitting diode and a driving transistor for driving the organic light-emitting diode; a first supply voltage line transferring a first voltage to the pixel circuit; at least a second supply voltage line transferring the first voltage to the pixel circuit during a first period and transferring a second voltage to the pixel circuit during a second period; and a switch connected between the first supply voltage line and the second supply voltage line, wherein the switch is turned on during the first period and turned off during the second period. Accordingly, it is possible to provide a structure for reducing variations in supply voltages of an organic light-emitting display device.

11 Claims, 6 Drawing Sheets

ORGANIC LIGHT-EMITTING DISPLAY DEVICE

CROSS-REFERENCE TO RELATED APPLICATIONS

This application claims the priority of Korean Patent Application No. 10-2018-0160710 filed on Dec. 13, 2018, in the Korean Intellectual Property Office, the disclosure of which is incorporated herein by reference.

BACKGROUND

Technical Field

The present disclosure relates to an organic light-emitting display (OLED) device.

Description of the Related Art

An organic light-emitting display device displays images by controlling an amount of light emitted from organic light-emitting elements. An organic light-emitting element (organic light-emitting diode, etc.) is a self-luminous devices using a thin emissive layer between electrodes and is advantageous in that it can be made thin. Typically, an organic light-emitting display device has a structure in which pixel-driving circuits and organic light-emitting elements are formed on a substrate. As the light emitted from the organic light-emitting elements transmits the substrate or a barrier layer, images are displayed.

Since the organic light-emitting display device is implemented without a separate light source, it can be made thinner and lighter than existing display devices such as a liquid-crystal display (LCD) device. Therefore, the organic light-emitting display device can be easily implemented as a flexible, bendable or foldable display device and can be designed in a variety of ways.

In an organic light-emitting display device, when a scan signal and a data voltage are supplied to sub-pixels, the light-emitting diodes of the selected sub-pixels emit light so that images are displayed. To this end, the organic light-emitting display device includes driving circuitry for driving sub-pixels and power circuitry for supplying power to the sub-pixels. The driving circuitry includes a scan driving circuit for supplying a scan signal (or a gate signal) and a data driving circuit for supplying a data voltage.

The driving circuitry and the power circuitry are becoming more complicated because they are required to perform a variety of functions to prevent deterioration as well as the driving of the sub-pixels. Accordingly, a variety of structures for optimizing the driving circuitry and the power circuitry have been studied and employed.

BRIEF SUMMARY

In view of the above, the present disclosure provides a structure for reducing variations in supply voltages of an organic light-emitting display device, and a method of driving it.

According to an aspect of the present disclosure, there is provided an organic light-emitting display device. The organic light-emitting display device may include: at least a pixel circuit comprising an organic light-emitting diode and a driving transistor for driving the organic light-emitting diode; a first supply voltage line transferring a first voltage to the pixel circuit; at least a second supply voltage line transferring the first voltage to the pixel circuit during a first period and transferring a second voltage to the pixel circuit during a second period; and a switch connected between the first supply voltage line and the second supply voltage line, wherein the switch is turned on during the first period and turned off during the second period.

The switch may be a transistor controlled by a signal identical to an emission control signal of the pixel circuit.

The first voltage may be a low-level supply voltage provided to the organic light-emitting diode, and the second voltage may be an initializing voltage provided to the driving transistor.

The at least one second supply voltage line may include a plurality of second supply voltage lines, and the switch may be disposed in each of the plurality of second supply voltage lines. Two or more pixel circuits may be connected to each of the second supply voltage lines, and the two or more pixel circuits may be arranged in different rows. An emission control signal may be supplied to the two or more pixel circuits at the same on/off timing.

The effects according to the present disclosure are not limited to the contents exemplified above, and more various effects are included in the present specification.

According to exemplary embodiments of the present disclosure, it is possible to overcome deterioration of image quality due to variations in supply voltages in a display device. Accordingly, according to exemplary embodiments of the present disclosure, an organic light-emitting display device with improved display quality can be provided. It should be noted that effects of the present disclosure are not limited to those described above and other effects of the present disclosure will be apparent to those skilled in the art from the following descriptions.

BRIEF DESCRIPTION OF THE SEVERAL VIEWS OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
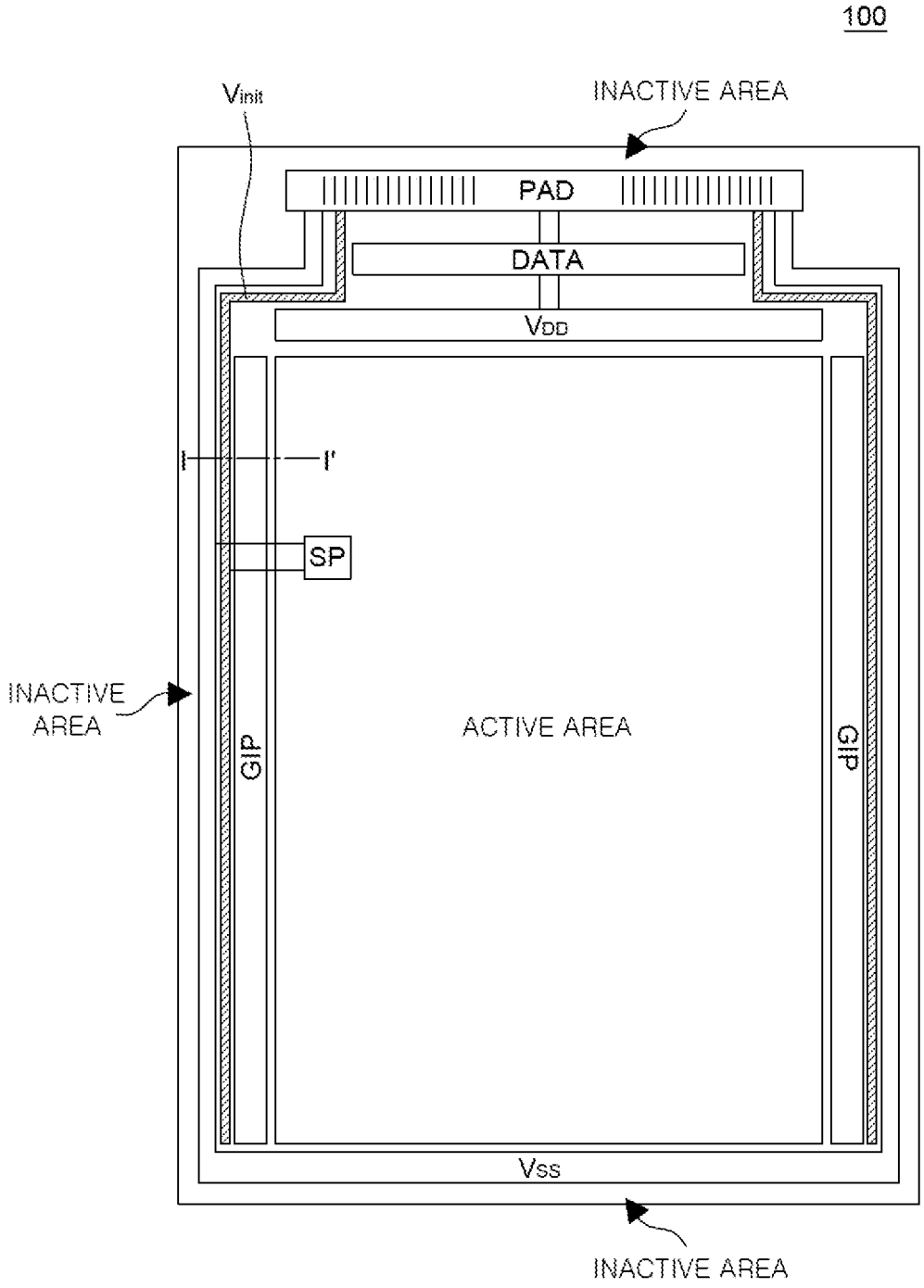
FIG. 1 shows an example of a display device that may be included in an electronic device.

Advantages and characteristics of the present disclosure and a method of achieving the advantages and characteristics will be clear by referring to exemplary embodiments described below in detail together with the accompanying drawings. However, the present disclosure is not limited to the exemplary embodiments disclosed herein but will be implemented in various forms. The exemplary embodiments are provided by way of example only so that those skilled in the art can fully understand the disclosures of the present disclosure and the scope of the present disclosure.

The shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the specification. Further, in the following description of the present disclosure, a detailed explanation of known related technologies may be omitted to avoid unnecessarily obscuring the subject matter of the present disclosure. The terms such as "including," "having" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly".

When an element or layer is disposed "on" another element or layer, another layer or another element may be interposed directly on the other element or therebetween.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Like reference numerals generally denote like elements throughout the specification.

A size and a thickness of each component illustrated in the drawing are illustrated for convenience of description, and the present disclosure is not limited to the size and the thickness of the component illustrated.

The features of various embodiments of the present disclosure can be partially or entirely adhered to or combined with each other and can be interlocked and operated in technically various ways, and the embodiments can be carried out independently of or in association with each other.

Hereinafter, a display device according to exemplary embodiments of the present disclosure will be described in detail with reference to accompanying drawings.

FIG. 1 shows an example of a display device that may be included in an electronic device.

Referring to FIG. 1, a display device 100 includes at least one active area, in which an array of pixels is formed. One or more inactive areas may be disposed around the active area. That is to say, the inactive areas may be adjacent to one or more sides of the active area. In FIG. 1, for example, the inactive areas surround a rectangular active area. However, the shape of the active area and the shape/layout of the inactive areas adjacent to the active area are not limited to those shown in FIG. 1. The active area and the inactive areas may have shapes appropriate for the design of an electronic device employing the display device 100. For example, the active area may have a pentagon shape, a hexagon shape, a circle shape, an ellipse shape, etc. The shape of the area is not limited to the enumerated examples.

Each of the pixels in the active area may be associated with a pixel circuit. The pixel circuit may include at least one switching transistor and at least one driving transistor on a backplane. Each pixel circuit may be electrically connected to gate lines and data lines so as to communicate with one or more driving circuits disposed in the inactive area, such as a gate driver and a data driver.

The driving circuits may be implemented as thin-film transistors (TFTs) in the inactive area, as shown in FIG. 1. The driving circuit may be referred to as a GIP (gate-in-panel). In addition, some components such as a data driver IC may be mounted on a separated PCB and may be coupled with a connection interface (a pad, a bump, a pin, etc.) disposed in the inactive area by using a circuit film such as a FPCB (flexible printed circuit board), a COF (chip-on-film), a TCP (tape-carrier-package), etc. The inactive area may be bent together with the connection interface so that the printed circuit board (COF, PCB, etc.) may be positioned behind the display device 100.

The device 100 may include a variety of additional elements for generating a variety of signals or for driving the pixels in the active area. The additional elements for driving the pixels may include an inverter circuit, a multiplexer, an electro static discharge circuit, etc. The display device 100 may include additional elements associated with other features than driving the pixels. For example, the display device 100 may include additional elements for providing a touch sense feature, a user authentication feature (e.g., fingerprint recognition), a multi-level pressure sense feature, a tactile feedback feature or a haptic feedback feature, etc. The above-mentioned additional elements may be disposed in the inactive areas and/or an external circuit connected to the interconnect interface.

A part of the inactive area that may be seen from the front side of the display device may be covered with a bezel. The bezel may be formed as a separate structure, a housing or other suitable element. The part of the inactive area that may be seen on the front side of the display device may be hidden under an opaque mask layer including black ink (e.g., a polymer filled with carbon black), for example. The opaque mask layer may be disposed on a variety of layers (a touch sensor layer, a polarizing layer, a cover layer, etc.) included in the display device 100.

Figure 2:
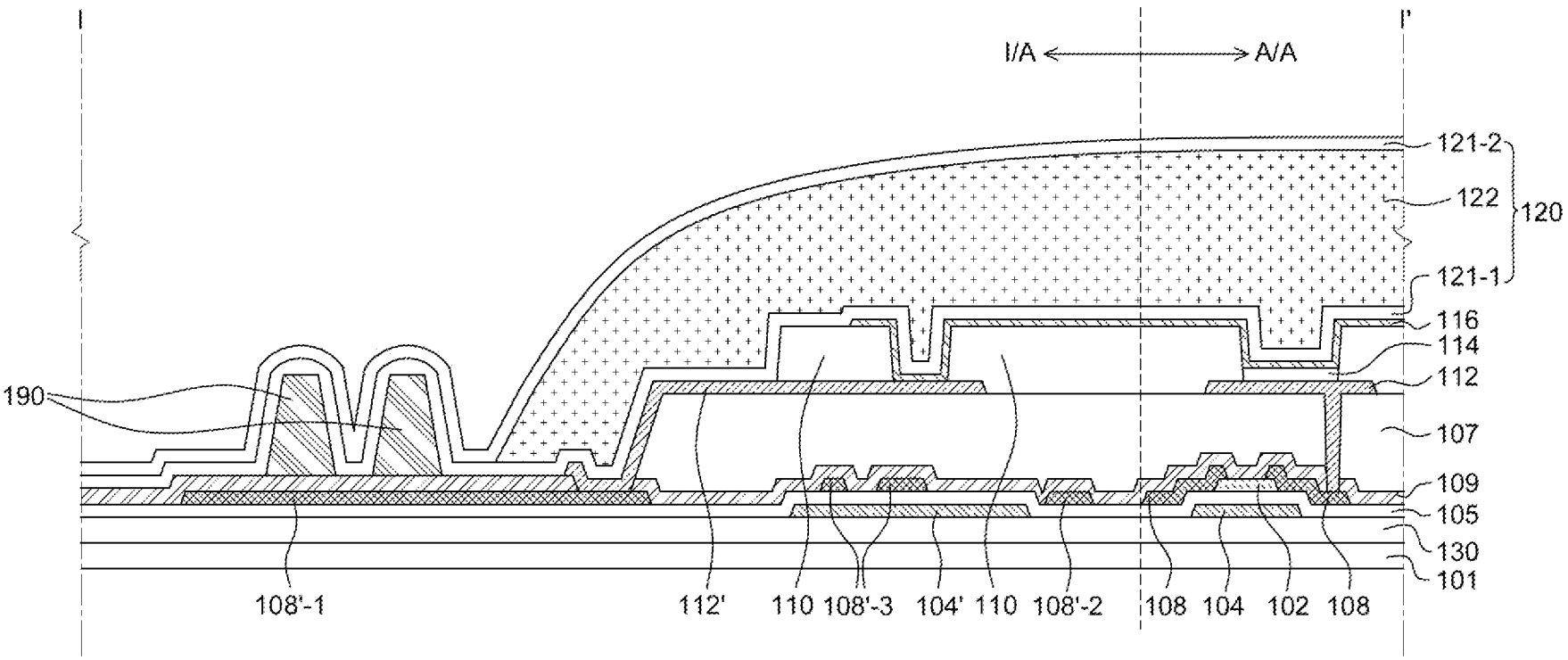
FIG. 2 is a cross-sectional view schematically showing an active area and an inactive area of a display device according to an exemplary embodiment of the present disclosure.

FIG. 2 is a cross-sectional view schematically showing an active area and an inactive area of a display device according to an exemplary embodiment of the present disclosure.

The active area A/A and the inactive area I/A shown in FIG. 2 may be applied to at least a part of the active area A/A and the inactive area I/A described above with reference to FIG. 1. In the following description, an organic light-emitting display device is described as an example of the display device.

In an organic light-emitting display device, thin-film transistors 102, 104 and 108, organic light-emitting elements 112, 114 and 116, and a variety of functional layers are disposed on a base layer 101 in the active area A/A. On the other hand, a variety of driving circuits (e.g., GIP), electrodes, lines, functional structures, etc., may be disposed on the base layer 101 in the inactive area I/A.

The base layer 101 supports various elements of the organic light-emitting display device 100. The base layer 101 may be made of a transparent, insulative material such as glass, plastic, etc. As used herein, the term "substrate (or array substrate)" may also refer to the base layer 101 as well as elements and functional layers formed thereon, e.g., a switching TFT, a driving TFT, an organic light-emitting element, a protective film, etc.

A buffer layer 130 may be disposed on the base layer 101. The buffer layer is a functional layer for protecting a thin-film transistor (TFT) from impurities such as alkali ions which leak from the base layer 101 or the underlying layers. The buffer layer may be made of silicon oxide (SiOx), silicon nitride (SiNx), or multiple layers thereof. The buffer layer 130 may include a multi-buffer and/or an active buffer.

The thin-film transistors are disposed on the base layer 101 or the buffer layer 130. The thin-film transistors may be formed by sequentially stacking an active layer, a gate insulator, a gate electrode, an interlayer dielectric layer ILD, and source and drain electrodes. Alternatively, the thin-film transistors may be formed by sequentially stacking the gate electrode 104, the gate insulator 105, the semiconductor layer 102, and the source and drain electrodes 108 as shown in FIG. 2.

The semiconductor layer 102 may be made of a polysilicon (p-Si), a predetermined region of which may be doped with impurities. In addition, the semiconductor layer 102 may be made of amorphous silicon (a-Si) or may be made of a variety of organic semiconductor materials such as pentacene. Further, the semiconductor layer 102 may be made of oxide as well.

The gate electrode 104 may be made of a variety of conductive materials such as magnesium (Mg), aluminum (Al), nickel (Ni), chrome (Cr), molybdenum (Mo), tungsten (W), gold (Au) or an alloy thereof.

The gate insulator 105 and interlayer dielectric layer ILD may be formed of an insulative material such as silicon oxide (SiOx) and silicon nitride (SiNx) or may be made of an insulative organic material. By selectively removing the gate insulator 105 and the interlayer dielectric layer, contact holes may be formed via which a source region and a drain region are exposed, respectively.

The source and drain electrodes 108 are formed on the gate insulator 105 or the interlayer dielectric layer ILD with a material for an electrode and is made up of a single layer or multiple layers. A passivation layer 109 made of an inorganic insulating material may cover the source and drain electrodes 108, as desired.

A planarization layer 107 may be disposed above the thin-film transistor. The planarization layer 107 protects the thin-film transistor and provides a flat surface over it. The planarization layer 107 may have a variety of forms. For example, the passivation layer 107 may be made of an organic insulation film such as BCB (benzocyclobutene) and acryl or may be made of an inorganic insulation film such as silicon nitride (SiNx) film and silicon oxide (SiOx) film. In addition, the passivation layer 107 may be made up of a single layer, a double layer, or a multi-layer.

The organic light-emitting element may be formed by stacking a first electrode 112, an organic emission layer 114 and a second electrode 116 in this order. That is to say, the organic light-emitting element may include the first electrode 112 formed on the passivation layer 107, the organic emission layer 114 disposed on the first electrode 112, and the second electrode 116 disposed on the organic emission layer 114.

The first electrode 112 is electrically connected to the drain electrode 108 of the driving thin-film transistor via the contact hole. In the case where the organic light-emitting display device 100 is of top-emission type, the first electrode 112 may be made of an opaque conductive material having high reflectivity. For example, the first electrode 112 may be made of silver (Ag), aluminum (Al), gold (Au), molybdenum (Mo), tungsten (W), chrome (Cr) or an alloy thereof. The first electrode 112 may be the anode of the organic light-emitting diode.

A bank 110 is formed in the rest of the area except at an emission area. Accordingly, the bank 110 has a bank hole corresponding to the emission area, via which the first electrode 112 is exposed. The bank 110 may be made of either an inorganic insulative material such as silicon nitride (SiNx) layer and silicon oxide (SiOx) layer or an organic insulative material such as BCB, acryl-based resin or imide-based resin.

The organic emission layer 114 is disposed on the first electrode 112 exposed via the hole of the bank 110. The organic emission layer 114 may include an emissive layer, an electron injection layer, an electron transport layer, a hole transport layer, a hole injection layer, etc. The organic emission layer may be made up of a single emissive layer emitting light of a color or may be made up of a plurality of emissive layers to emit white light.

The second electrode 116 is disposed on the organic emission layer 114. In the case where the organic light-emitting display device 100 is of top-emission type, the second electrode 116 is made of a transparent, conductive material such as indium tin oxide (ITO) or indium zinc oxide (IZO), such that light generated in the organic emission layer 114 exits upwardly through the second electrode 116. The second electrode 116 may be the cathode of the organic light-emitting diode.

A second electrode 116 is disposed on the encapsulation layer 120. The encapsulation layer 120 blocks oxygen and moisture or other foreign external materials from permeating from the outside to thereby suppress oxidation of luminous material and the material of the electrodes. If an organic light-emitting element is exposed to moisture or oxygen, the emission area may shrink, e.g., pixel shrinkage may take place or dark spots may appear in the emission area. The encapsulation layer may be formed as an inorganic layer made of glass, metal, aluminum oxide (AlOx) or silicon (Si)-based material or may be formed by stacking an organic layer 122 and inorganic layers 121_1 and 121_2 alternately. The inorganic layers 121_1 and 121_2 serve to block the permeation of moisture or oxygen. The organic layer 122 covers particles to provide the flat surface on the inorganic layers 121_1 and 121_2. By forming the encapsulation layer of multiple thin film layers, the paths in which moisture or oxygen may possibly permeate become longer and more complicated than those of a single layer, to make permeation of moisture/oxygen into the organic light-emitting elements difficult.

A barrier film (not shown) may be disposed on the encapsulation layer 120 to encapsulate the entirety of the base layer 101. The barrier film may be a retarded film or an optically isotropic film. An adhesive layer may be positioned between the barrier film and the encapsulating layer 120. The adhesive layer attaches the encapsulation layer 120 to the barrier film. The adhesive layer may be a heat-curable or naturally-curable adhesive. For example, the adhesive layer may be made of a material such as B-PSA (barrier pressure sensitive adhesive).

Although the pixel circuit and the light-emitting elements are not disposed in the inactive area I/A, the base layer 101 and the organic/inorganic functional layers 130, 105, 107 and 120, etc., may be disposed therein. In addition, the materials used in forming the elements in the active area A/A may be disposed in the inactive area I/A for other purposes. For example, the same metal 104' as the gate electrode of the TFTs or the same metal 108' as the source/drain electrode in the active area may be disposed in the inactive area I/A for lines or electrodes. Furthermore, the same metal 112' as one electrode (for example, the anode) of the organic light-emitting diode may be disposed in the inactive area I/A for lines and electrodes.

The base layer 101, the buffer layer 130, the gate insulator 105, the planarization layer 107, and the like in the inactive area I/A are identical to those in the active area A/A described above. A dam 190 is a structure that restricts the organic layer 122 so that it does not spread too far in the inactive area I/A. A variety of circuits and electrodes/lines disposed in the inactive area I/A may be made of the gate metal 104' and/or the source/drain metal 108'. The gate metal 104' is formed via the same process with the same material as the gate electrode of the TFT. The source/drain metal 108' is formed via the same process with the same material as the source/drain electrode of the TFT.

For example, the source/drain metal may be used as a supply voltage line 108' (e.g., low-level supply voltage $V_{SS}$). In such case, the supply voltage line 108' may be connected to the metal layer 112', and the cathode 116 of the organic light-emitting diode may be connected to the source/drain metal 108' and the metal layer 112' so that the supply voltage may be received. The metal layer 112' may be in contact with the supply voltage line 108' and may be extended along the outermost sidewall of the planarization layer 107, so that it may be in contact with the cathode 116 on the planarization layer 107. The metal layer 112' may be a metal layer formed via the same process with the same material as the anode 112 of the organic light-emitting diode.

Figure 3A:
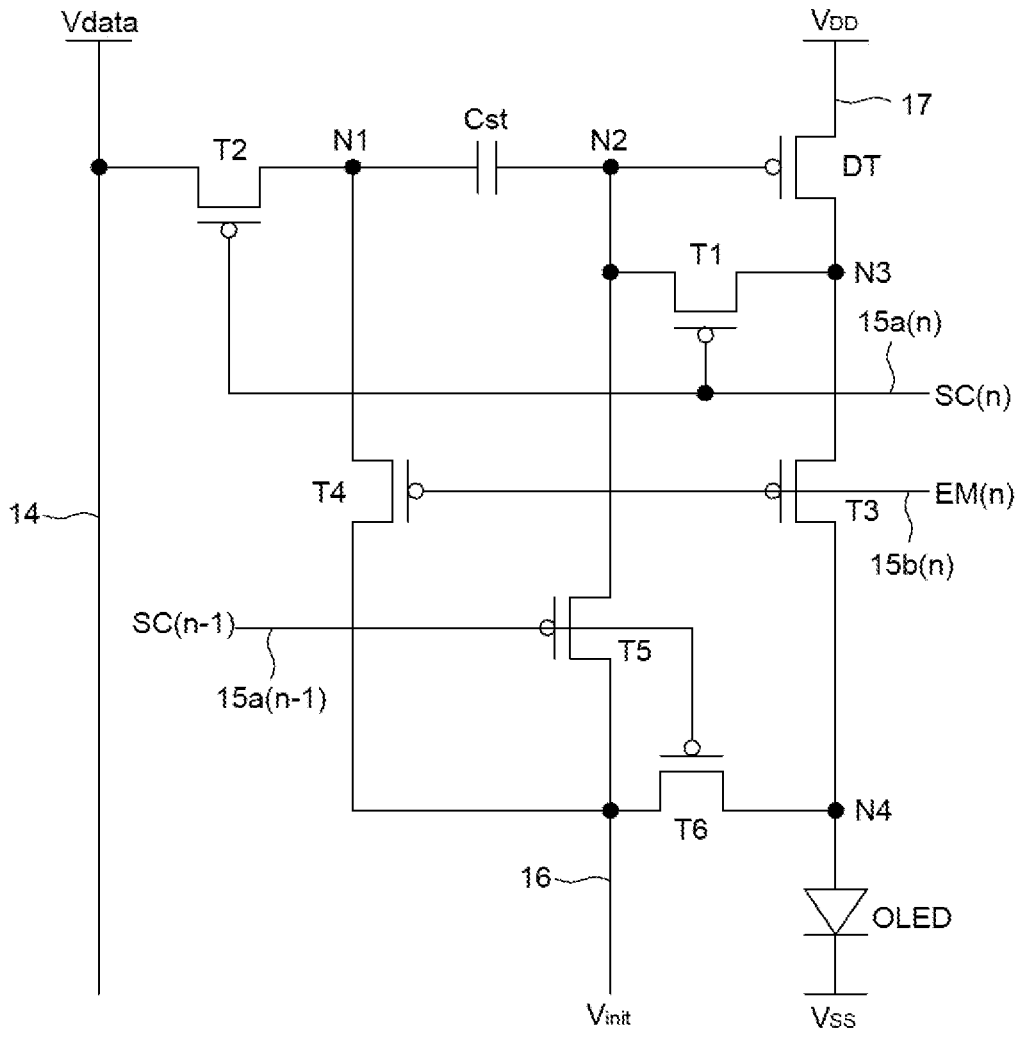
FIGS. 3A and 3B are exemplary diagrams showing a pixel circuit and operation timings of an organic light-emitting display device according to an exemplary embodiment of the present disclosure.
Figure 3B:
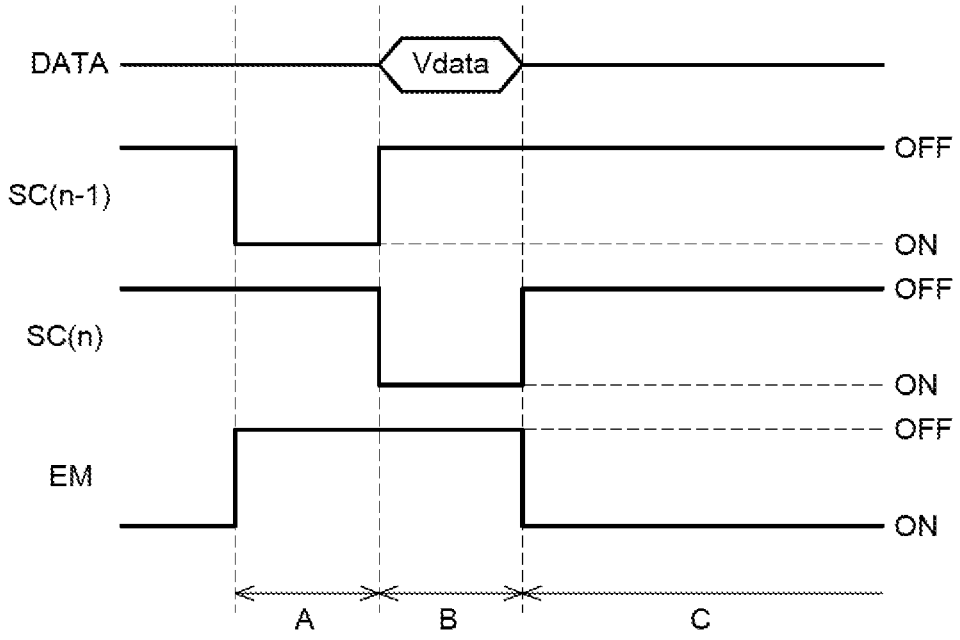

FIGS. 3A and 3B are exemplary diagrams showing a pixel circuit and operation timings of an organic light-emitting display device according to an exemplary embodiment of the present disclosure.

Referring to FIG. 3A, according to the exemplary embodiment of the present disclosure, the pixel circuit includes an organic light-emitting diode OLED, a plurality of thin-film transistors (TFTs) ST1 to ST6 and DT, and a storage capacitor $C_{st}$. The TFTs ST1 to ST6 and DT may be implemented as PMOS LTPS TFTs. As another example, at least one of the switch TFTs ST1 to ST6 may be an NMOS oxide TFT having good off-current characteristics while the other TFTs may be implemented as PMOS LTPS TFTs having good response characteristics.

The OLED emits light in proportion to the electric current adjusted by the gate-source voltage of the driving TFT DT. The anode electrode of the OLED is connected to a fourth node N4, and the cathode electrode of the OLED is connected to the low-level supply voltage terminal $V_{SS}$. An organic layer is disposed between the anode electrode and the cathode electrode. The organic layer may include, but is not limited to, a hole injection layer (HIL), a hole transport layer (HTL), an emission layer (EML), an electron transport layer (ETL), and an electron injection layer EIL.

The driving TFT DT is a driving element for adjusting the current flowing in the OLED according to the gate-source voltage Vgs. The driving TFT DT includes a gate electrode connected to a second node N2, a source electrode connected to a first supply voltage line 17, and a drain electrode connected to a third node N3.

The first switch TFT ST1 is connected between the second node N2 and the third node N3 and is switched on/off according to the $n^{th}$ scan signal SC(n). The gate electrode of the first switch TFT ST1 is connected to the $n^{th}$ first gate line 15*a*(*n*) to which the $n^{th}$ scan signal SC(n) is applied, the source electrode of the first switch TFT ST1 is connected to the third node N3, and the drain electrode of the first switch TFT ST1 is connected to the second node N2.

The second switch TFT T2 is connected between the data line 14 and the first node N1 and is switched according to the $n^{th}$ scan signal SC(n). The gate electrode of the second switch TFT ST2 is connected to the $n^{th}$ first gate line 15*a*(*n*) to which the $n^{th}$ scan signal SC(n) is applied, the source electrode of the second switch TFT ST2 is connected to the data line 14, and the drain electrode of the second switch TFT ST2 is connected to the first node N2.

The third switch TFT T3 is connected between the third node N3 and the fourth node N4 and is switched according to the $n^{th}$ emission signal EM(n). The gate electrode of the third switch TFT T3 is connected to the $n^{th}$ second gate line 15*b*(*n*) to which the $n^{th}$ emission signal EM(n) is applied, the source electrode of the third switch TFT T3 is connected to the third node N3, and the drain electrode of the third switch TFT T3 is connected to the fourth node N4.

The fourth switch TFT T4 is connected between the first node N1 and the second supply voltage line 16 and is switched according to the $n^{th}$ emission signal EM(n). The gate electrode of the fourth switch TFT T4 is connected to the $n^{th}$ second gate line 15*b*(*n*) to which the $n^{th}$ emission signal EM(n) is applied, the source electrode of the fourth switch TFT T4 is connected to the first node N1, and the drain electrode of the third switch TFT T3 is connected to the second supply voltage line 16.

The fifth switch TFT T5 is connected between the second node N2 and the second supply voltage line 16 and is switched according to the $(n-1)^{th}$ scan signal SC(n−1). The gate electrode of the fifth switch TFT T5 is connected to the $(n-1)^{th}$ first gate line 15*a*(*n*−1) to which the $(n-1)^{th}$ scan signal SC(n−1) is applied, the source electrode of the fifth switch TFT ST5 is connected to the second node N2, and the drain electrode of the fifth switch TFT ST4 is connected to the second supply voltage line 16.

The sixth switch TFT T6 is connected between the fourth node N4 and the second supply voltage line 16 and is switched according to the $(n-1)^{th}$ scan signal SC(n−1). The gate electrode of the sixth switch TFT T6 is connected to the $(n-1)^{th}$ first gate line 15*a*(*n*−1) to which the $(n-1)^{th}$ scan signal SC(n−1) is applied, the source electrode of the sixth switch TFT ST6 is connected to the sixth node N4, and the drain electrode of the sixth switch TFT ST6 is connected to the second supply voltage line 16.

The storage capacitor $C_{st}$ is connected between the first node N1 and the second node N2.

FIG. 3B is a waveform diagram showing level changes of driving signals input to the pixel circuit of FIG. 3A. Referring to FIG. 3B, the pixel circuit may be driven through an initialization period A, a compensation period B following the initialization period A, and an emission period C following the compensation period B. During the initialization period A, the compensation period B and the emission period C, the cathode voltage $V_{SS}$ of the OLED and the initializing voltage $V_{init}$ remains constant.

In the initialization period A, the (n−1) scan signal SC(n−1) at the on-level ON is input, and the $n^{th}$ scan signal SC(n) and the $n^{th}$ emission signal EM(n) at the off-level OFF are input. During the initialization period A, the fifth switch TFT T5 and the sixth switch TFT T6 are turned on in response to the $(n-1)^{th}$ scan signal SC(n−1) of the on-level ON. The initializing voltage $V_{init}$ is applied to the second node N2 by turning on the fifth switch TFT T5, and the initializing voltage Vin is applied to the fourth node N4 by turning on the sixth switch TFT T6. The initializing voltage $V_{init}$ having a level lower than the high-level supply voltage $V_{DD}$ and equal to or higher than the low-level supply voltage $V_{SS}$. During the initialization period A, the gate-source voltage Vgs of the driving TFT DT, i.e., "$V_{DD}-V_{init}$" is larger than the threshold voltage $V_{th}$ of the driving TFT DT, and thus the driving TFT DT can be turned on. Therefore, during the initialization period A, the high-level supply voltage $V_{DD}$ is applied to the third node N3. On the other hand, the initializing voltage $V_{init}$ applied to the second node N2 is lower than the operating point voltage of the OLED, and thus the OLED does not emit light during the initialization period A.

During the initialization period A, the first switch TFT T1 and the second switch TFT T2 are turned off in response to the $n^{th}$ scan signal SC(n) of the off-level OFF. During the initialization period A, the first node N1 holds the initializing voltage $V_{init}$ charged during the emission period of the previous frame. In addition, during the initialization period A, the third switch TFT T3 and the fourth switch TFT T4 are turned off in response to the $n^{th}$ emission signal EM(n) at the off-level OFF.

As a result, during the initialization period A, the voltage at the first node N1, the second node N2 and the fourth node N4 is equal to the initializing voltage $V_{init}$, while the voltage at the third node N3 is equal to the high-level supply voltage $V_{DD}$.

During the compensation period B, the first switch TFT T1 and the second switch TFT T2 are turned on in response to the $n^{th}$ scan signal SC(n) of the on-level ON. As the first switch TFT T1 is turned on, a short-circuit is formed between the gate electrode and the drain electrode of the driving TFT DT, such that the driving TFT DT has a diode-connection. As the driving TFT DT has the diode-connection, the threshold voltage $V_{th}$ of the driving TFT DT is sampled and stored at the second node N2 and the third node N3. As the second switch TFT T2 is turned on, the data voltage $V_{data}$ applied to the data line 14 is applied to the first node N1.

During the compensation period B, the third switch TFT T3 and the fourth switch TFT T4 are turned off in response to the $n^{th}$ emission signal EM(n) at the off-level OFF. Then, during the compensation period B, the fifth switch TFT T5 and the sixth switch TFT T6 are turned off in response to the $(n-1)^{th}$ scan signal SC(n−1) of off-level OFF.

As a result, during the compensation period B, the voltage at the first node N1 is equal to the data voltage $V_{data}$, the voltage at the second node N2 and the third node N3 is equal to the "$V_{DD}-V_{th}$", and the voltage at the fourth node N4 is equal to the initializing voltage $V_{init}$.

During the emission period C, the third switch TFT T3 and the fourth switch TFT T4 are turned on in response to the $n^{th}$ emissive layer signal EM(n) at the on-level ON. During the emission period C, the first switch TFT T1 and the second switch TFT T2 are turned off in response to the $n^{th}$ scan signal SC(n) of off-level OFF. Then, during the emission period C, the fifth switch TFT T5 and the sixth switch TFT T6 are turned off in response to the $(n-1)^{th}$ scan signal SC(n−1) of off-level OFF.

During the emission period C, the initializing voltage $V_{init}$ is applied to the first node N1 as the fourth switch TFT T4 is turned on, and the voltage at the first node N1 is decreased to the initializing voltage $V_{init}$ from the data voltage $V_{data}$ during the previous compensation period B.

During the emission period C, the second node N2 is floating and coupled to the first node N1 through the storage capacitor $C_{st}$. Therefore, during the emission period C, the voltage change "$V_{data}-V_{init}$" of the first node N1 is reflected to the second node N2. As a result, the voltage at the second node N2 is decreased by "$V_{data}-V_{init}$" from the "$V_{DD}-V_{th}$" of the previous compensation period B during the emission period C. In other words, the voltage at the second node N2 is equal to "$V_{DD}-V_{th}-V_{data}+V_{init}$" during the emission period C. On the other hand, during the emission period C, the voltage at the third node N3 and the fourth node N4 becomes equal to "$V_{DD}-V_{th}$". In this manner, the Vgs voltage of the driving TFT DT for determining the amount of driving current of the OLED is set.

The inventors have found several shortcomings in the circuit and power supply structure described above. One of them is the voltage variations in the low-level supply voltage depending on the positions of the pixels. The low-level supply voltage $V_{SS}$ is applied to a lead-in part (e.g., PAD) on one side of the active area and is transmitted to the pixel circuits through a supply voltage line extended along the border. The voltage transmitted to a pixel circuit far from the lead-in part may be different from the voltage transmitted to a pixel circuit near the lead-in part due to the resistance of the conductive line or the like. Once the level of the low-level supply voltage $V_{SS}$ varies (for example, increases or decreases), the margin between the high-level supply voltage $V_{DD}$ and the low-level supply voltage $V_{SS}$ may not become sufficient enough and may cause the luminance or the color uniformity to deteriorate. In addition, such voltage variations of the low-level supply voltage $V_{SS}$ may cause failure in driving the display device. In view of the above, the inventors have further devised a structure for mitigating the voltage variations depending on the pixel positions.

Figure 4A:
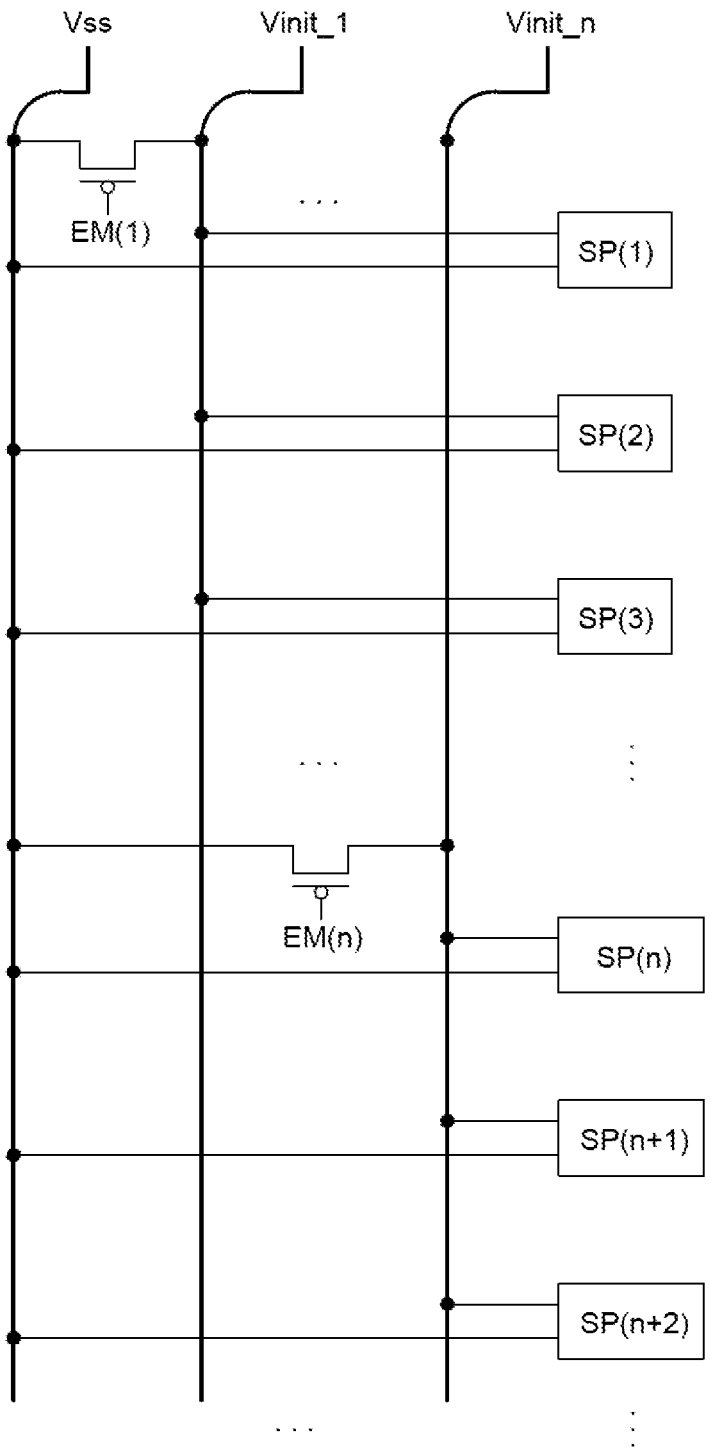
FIGS. 4A and 4B are diagrams illustrating a power supply structure and operation timing of an organic light-emitting display device according to another exemplary embodiment of the present disclosure.
Figure 4B:
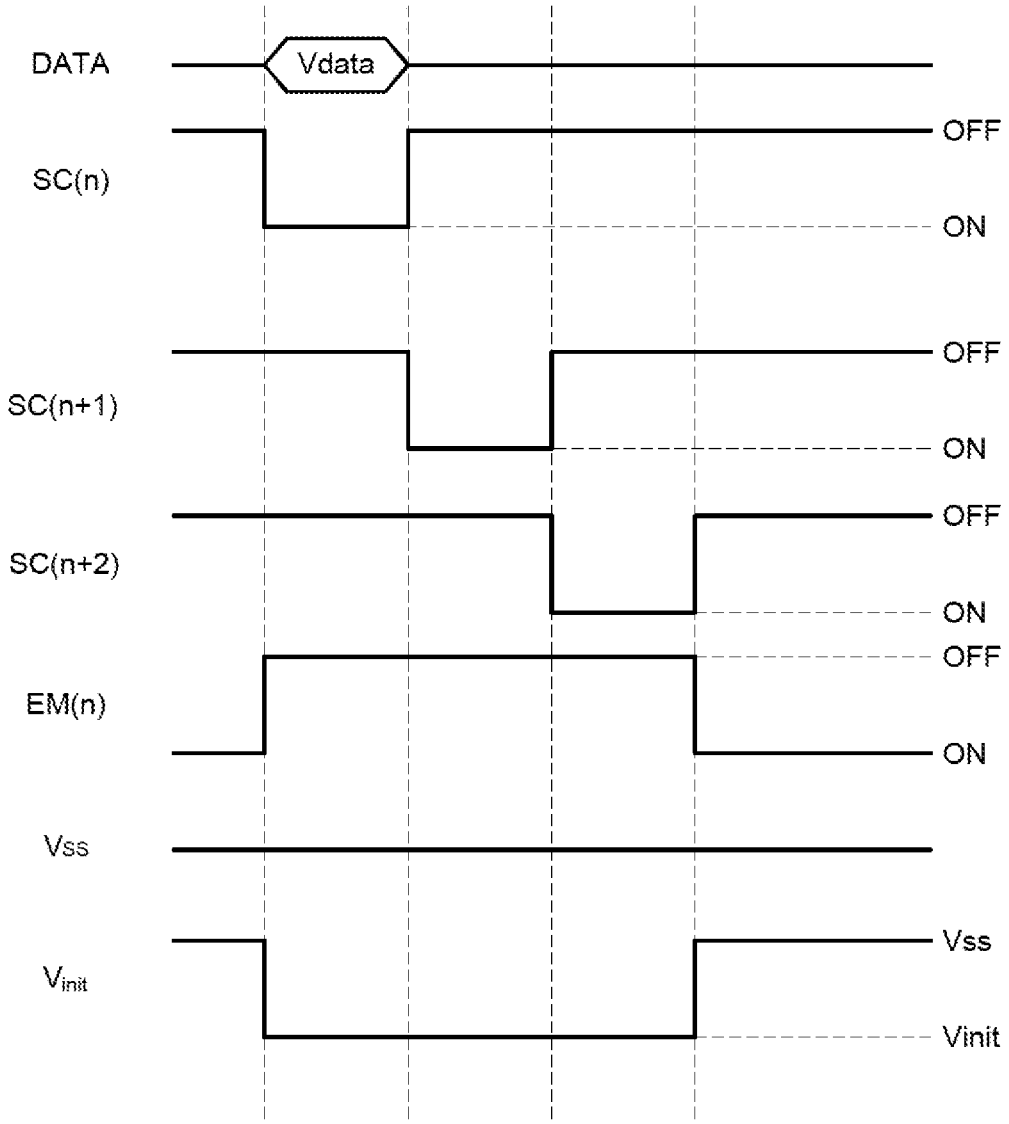

FIGS. 4A and 4B are diagrams illustrating a power supply structure and operation timing of an organic light-emitting display device according to another exemplary embodiment of the present disclosure. The embodiments shown in connection to FIGS. 4A and 4B further improve the embodiments described in accordance to FIGS. 3A and 3B.

The organic light-emitting display device employs an improved configuration that compensates for variations in the low-level supply voltage. FIG. 4A shows only specific supply voltage lines $V_{SS}$ and $V_{init}$ and does not show other conductors (data lines, gate lines, etc.) for convenience of illustration. The organic light-emitting display device may include pixel circuits SP(1) to SP(n) and supply voltage lines $V_{SS}$ and $V_{init}$.

Each of the pixel circuits SP(1) to SP(n) includes an organic light-emitting diode; a driving transistor for driving the organic light-emitting diode; a variety of switching elements, storage elements, and the like. The pixel circuit may have a configuration for initializing a specific node (for example, a driving transistor, an organic light-emitting diode, etc.) by receiving initializing voltage, and may be the circuit having the structure shown in FIG. 3A, for example.

The supply voltage lines $V_{SS}$ and $V_{init}$ are extended from a connection interface (e.g., PAD) to the active area and are electrically connected to the pixel circuits SP(1) to SP(n). The supply voltage lines may include a first supply voltage line $V_{SS}$ for transmitting a first voltage to the pixel circuits SP(1) to SP(n); and second supply voltage lines $V_{init_1}$ to $V_{init_n}$ for transmitting a second voltage to the pixel circuits SP(1) to SP(n). The second supply voltage lines $V_{init_1}$ to $V_{init_n}$ may transfer the first voltage to the pixel circuits SP(1) to SP(n) in a first period, and may transfer the second voltage to the pixel circuits SP(1) to SP(n) during a second period. In some embodiments, the first period and the second period may not overlap with each other. The first voltage may be a low-level supply voltage $V_{SS}$ provided to the organic light-emitting diode, and the second voltage may be an initializing voltage $V_{init}$ provided to the driving transistor. The level of the second voltage may be less than the level of the first voltage. For example, the first voltage may be about −3.0 volts and the second voltage may be about −4.5 volts. In this manner, by transferring the first voltage and the second voltage to the second supply voltage lines $V_{init}$ in different periods, the second supply voltage lines work as an auxiliary line of the first supply voltage line (in the first period). Thus, the first voltage can be applied more stably, and therefore the variation of the first voltage can be suppressed because the first voltage is applied through the second supply voltage lines $V_{init}$.

A switch may be connected between the first supply voltage line $V_{SS}$ and the second supply voltage line $V_{init}$. The switch may be turned on in the first period and turned off in the second period. Accordingly, in the first period where the switch is on, the first supply voltage line $V_{SS}$ and the second supply voltage line $V_{init}$ both transmit the first voltage, while in the second period where the switch is off, the first supply voltage line $V_{SS}$ transmits the first voltage and the second supply voltage line $V_{init}$ transmits the second voltage. Thus, in the first period where the switch is on, the second supply voltage line works as an auxiliary line of the first supply voltage line. The switch may be a transistor controlled by the same signal as the emission control signals EM(1) to EM(n) of the pixel circuit, as in the example of FIG. 4A. Since the emission period (the period where the EM signal is at on-level) is longer than the non-emission period (the period during where the EM signal is at off-level) for an organic light-emitting display device, the first supply voltage line $V_{SS}$ can apply the low-level supply voltage for a sufficiently long period of time, with the aid of the second supply voltage lines $V_{init}$. From a different point of view, the second supply voltage lines $V_{init}$ can be utilized more efficiently, which otherwise transmit the initializing voltage during a relatively short non-emission period (the period where the EM signal is at the off-level) and remain idle.

As shown in FIG. 4A, a plurality of the second supply voltage lines may be disposed. The switch may be disposed in each of the plurality of second supply voltage lines $V_{init_1}$ to $V_{init_n}$. In such implementation, only the pixel circuits in a row may be connected to each of the second supply voltage lines. However, as shown in FIG. 4A, two or more pixel circuits are connected to each of the second supply voltage lines, and the two or more pixel circuits may be arranged in different rows. Although the pixel circuits in three rows are connected to each of the second supply voltage lines in the example shown in FIG. 4A, the pixel circuits in two, four or more rows may be connected to each of the second supply voltage lines. As such, the emission control signals may be provided to the pixel circuits connected to the same second supply voltage line at the same on/off timing. For example, the pixel circuits SP(n), SP(n+1) and SP(n+2) connected to the $n^{th}$ second supply voltage line $V_{init_n}$ may be controlled by the emission control signals (e.g., EM(n) signal in FIG. 4B) having the same on-off timing. That is to say, the pixel circuits SP(n), SP(n+1) and SP(n+2) can emit light by the emission control signal EM(n) at the same timing.

The organic light-emitting display device may further include a power management unit for supplying a variable supply voltage through the second supply voltage lines $V_{init}$, that is, for supplying different voltages during the first and second periods, respectively, to the second supply voltage lines $V_{init}$. The power management unit can apply different voltages to the second supply voltage lines $V_{init}$ based on the emission control signal EM received from a scan driving circuit and the like. The power management unit may be included in a power management integrated circuit (PMIC).

The line width of the first supply voltage line $V_{SS}$ may be larger than the line width of the second supply voltage lines $V_{init}$. The first supply voltage line $V_{SS}$ may be formed of the same material on the same layer as the source or drain electrode of the thin-film transistor TFT included in the pixel circuit. The first supply voltage line $V_{SS}$ may be a metal layer (so-called Ti/Al/Ti) having a multilayer structure stacked in the order of titanium (Ti), aluminum (Al), and titanium (Ti). The second supply voltage lines $V_{init}$ may be formed of the same material as the first supply voltage line $V_{SS}$ or as the anode electrode of the organic light-emitting diode OLED.

By employing the above-described power supply structure according to the exemplary embodiments of the present disclosure, it is possible to reduce variations in the supply voltages, especially $V_{SS}$. Accordingly, according to the exemplary embodiments of the present disclosure, there is a sufficient margin between the supply voltages, so that it is possible to implement a display device with improved color and/or luminance uniformity.

Although the exemplary embodiments of the present disclosure have been described in detail with reference to the accompanying drawings, the present disclosure is not limited thereto and may be embodied in many different forms without departing from the technical concept of the present disclosure. Therefore, the exemplary embodiments of the present disclosure are provided for illustrative purposes only but not intended to limit the technical concept of the present disclosure. The scope of the technical concept of the present disclosure is not limited thereto. Therefore, it should be understood that the above-described exemplary embodiments are illustrative in all aspects and do not limit the present disclosure. All the technical concepts having a substantially equivalent scope with the present disclosure should be construed as falling within the scope of the present disclosure.

The various embodiments described above can be combined to provide further embodiments. Further changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An organic light-emitting display device, comprising:

a pixel circuit including an organic light-emitting diode and a driving transistor for driving the organic light-emitting diode, the pixel circuit configured to receive an emission control signal controlling emission of the organic light-emitting diode;

a first supply voltage line transferring a first voltage to the pixel circuit;

a plurality of second supply voltage lines transferring the first voltage to the pixel circuit during a first period and transferring a second voltage to the pixel circuit during a second period; and a switch directly connected to the first supply voltage line and a second supply voltage line of the plurality of second supply voltage lines, wherein the switch is in an on state during at least part of the first period and in an off state during at least part of the second period, and wherein the first voltage is a low-level supply voltage provided to the organic light-emitting diode, and the second voltage is an initializing voltage provided to the driving transistor.

2. The organic light-emitting display device of claim 1, wherein the switch includes a transistor controlled by a signal identical to the emission control signal of the pixel circuit.

3. The organic light-emitting display device of claim 1, wherein a level of the second voltage is smaller than a level of the first voltage.

4. The organic light-emitting display device of claim 1, wherein variations in the first voltage is suppressed by the second supply voltage line supplying the first voltage as an auxiliary line during the first period.

5. The organic light-emitting display device of claim 1, wherein the switch is disposed in each of the plurality of second supply voltage lines.

6. The organic light-emitting display device of claim 5, wherein two or more pixel circuits are connected to each of the second supply voltage lines, and wherein the two or more pixel circuits are disposed in different rows.

7. The organic light-emitting display device of claim 5, wherein an emission control signal is supplied to the two or more pixel circuits at substantially the same on/off timing.

8. The organic light-emitting display device of claim 1, further comprising:

a power management circuit configured to supply different voltages to the second supply voltage line in the first and second periods, respectively.

9. The organic light-emitting display device of claim 1, wherein a line width of the first supply voltage line is larger than a line width of the second supply voltage line.

10. The organic light-emitting display device of claim 1, wherein the first supply voltage line is formed of a same material as a source electrode or drain electrode of a thin-film transistor included in the pixel circuit.

11. The organic light-emitting display device of claim 10, wherein the second supply voltage line is formed of a same material as the first supply voltage line or as an anode electrode of the organic light-emitting diode.

* * * * *